US008676099B2

(12) United States Patent
Hattori et al.

(10) Patent No.: US 8,676,099 B2
(45) Date of Patent: Mar. 18, 2014

(54) DEVELOPING APPARATUS, PROCESS CARTRIDGE, AND IMAGE FORMING APPARATUS

(75) Inventors: Yoshio Hattori, Kanagawa (JP); Yoshiyuki Fukuda, Tokyo (JP); Atsushi Nakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 237 days.

(21) Appl. No.: 13/027,609

(22) Filed: Feb. 15, 2011

(65) Prior Publication Data

US 2011/0217085 A1 Sep. 8, 2011

(30) Foreign Application Priority Data

Mar. 4, 2010 (JP) ..... 2010-048063

(51) Int. Cl.
*G03G 15/09* (2006.01)
*G03G 15/08* (2006.01)

(52) U.S. Cl.
CPC ..... *G03G 15/09* (2013.01); *G03G 15/0921* (2013.01); *G03G 15/0812* (2013.01); *G03G 15/0891* (2013.01)
USPC ..... 399/274; 399/254; 399/273

(58) Field of Classification Search
CPC ..... G03G 15/0808; G03G 15/0812; G03G 15/0921
USPC ..... 399/254, 256, 273, 274
See application file for complete search history.

(56) References Cited

U.S. PATENT DOCUMENTS 6,393,241 B1 5/2002 Matsumoto et al.
6,438,344 B1 * 8/2002 Fujimoto ..... 399/254
6,591,077 B2 7/2003 Yanagisawa et al.
6,628,908 B2 9/2003 Matsumoto et al.
6,775,503 B2 8/2004 Hattori et al.
6,973,281 B2 12/2005 Hirobe et al.
7,463,845 B2 12/2008 Suda et al.
7,463,852 B2 12/2008 Yoshida et al.
7,466,945 B2 12/2008 Hattori
7,599,650 B2 10/2009 Katoh et al.
7,813,680 B2 10/2010 Masuda et al.
2007/0170211 A1 7/2007 Hattori
2008/0085137 A1 * 4/2008 Suzuki ..... 399/254
2008/0226355 A1 * 9/2008 Koetsuka et al. ..... 399/277
2009/0136257 A1 5/2009 Hattori et al.
2009/0245882 A1 10/2009 Ozeki et al.
2009/0245889 A1 10/2009 Koetsuka et al.

(Continued)

FOREIGN PATENT DOCUMENTS

JP 5-333691 12/1993
JP 11-174810 7/1999

(Continued)

*Primary Examiner* — Benjamin Schmitt
(74) *Attorney, Agent, or Firm* — Oblon, Spivak, McClelland, Maier & Neustadt, L.L.P.

(57) ABSTRACT

A developing apparatus contains a developer for developing a latent image formed on an image carrier. The developing apparatus includes a developer carrier disposed opposite to the image carrier; a developer regulating member regulating an amount of the developer carried by the developer carrier; and a developer circulating unit transporting the developer in a circulating path. The developer circulating unit includes a rotatable first transport member supplying the developer to the developer carrier while transporting the developer in a horizontal direction, a shielding member preventing the developer separated from the developer carrier from flowing back toward the first transport member, and a rotatable second transport member collecting the developer separated from the developer carrier while transporting the developer in the horizontal direction. A distance between the second transport member and the developer carrier is greater than a distance between the first transport member and the developer carrier.

22 Claims, 6 Drawing Sheets

(56) References Cited

U.S. PATENT DOCUMENTS

| | | | | |
|---|---|---|---|---|
| 2009/0252538 | A1* | 10/2009 | Lioy | 399/254 |
| 2009/0257763 | A1* | 10/2009 | Hayashi | 399/53 |
| 2011/0058858 | A1 | 3/2011 | Fukuda et al. | |

FOREIGN PATENT DOCUMENTS

| | | | | | |
|---|---|---|---|---|---|
| JP | 2002-365873 | A | | 12/2002 | |
| JP | 2006-030241 | A | | 2/2006 | |
| JP | 2007-003713 | A | | 1/2007 | |
| JP | 2007003713 | A | * | 1/2007 | G03G 15/08 |
| JP | 3950735 | | | 4/2007 | |
| JP | 2007-148183 | A | | 6/2007 | |
| JP | 2007-293142 | A | | 11/2007 | |
| JP | 2008-268506 | A | | 11/2008 | |
| JP | 2009-122190 | | | 6/2009 | |
| JP | 2011-174954 | | | 9/2011 | |

* cited by examiner

DEVELOPING APPARATUS, PROCESS CARTRIDGE, AND IMAGE FORMING APPARATUS

BACKGROUND OF THE INVENTION

1. Field of the Invention

The present invention relates to developing apparatuses in image forming apparatuses.

2. Description of the Related Art

In a conventional developing apparatus based on the two-component (i.e., toner and carrier) developing system, typically two or three screws are disposed in parallel and extending in a horizontal direction. One of the screws is disposed opposite a developing roller and configured to supply a developer containing toner and carrier to the developing roller. The developer is supplied to and collected from the developing roller at the same time by the developer supply screw.

In order to enhance performance for handling color printing and achieve size reduction in a tandem layout, it has been proposed to supply and collect the developer by separate screws, one disposed above the other in a cross section. In such a system, the developer may be circulated in one direction, as discussed in Japanese Laid-Open Patent Publication Nos. 5-333691 (which may be referred to as "Patent Document 1") and 11-174810 (which may be referred to as "Patent Document 2"). In these examples, a doctor blade is disposed above the developing roller, and the developer is transported from the upper supply screw to the developing roller and then transported to the collecting screw disposed below the developing roller.

JP Patent No. 3950735 (which may be referred to as "Patent Document 3") discloses a developing apparatus in which the doctor blade is disposed below a pair of developing rollers, one disposed above the other, and that the developer is circulated in one direction. A supply screw is disposed under a collecting screw. The developer is transported up to the top of developing rollers, where the developer is separated at the top of the developing rollers. It is discussed that the level of stress imparted to the developer during its upward transport is reduced.

However, in the above related art, the developer separated from the developing roller may not be collected but again become attached to the developing roller because of the height of the developer accumulated in the downstream end of the collecting screw. Further, the image forming speed may be reduced depending on the type of a printing sheet (such as normal paper or thick paper) used in the image forming apparatus in which the developing apparatus is disposed. The image forming speed may also be reduced in a high-quality mode in which the number of dots formed in a latent image by an electrostatic latent image forming unit may be increased. For these reasons, multiple rotating speeds may be provided. As a result, the height of the accumulated developer may vary depending on the rotating speed of the developer transport screw. For example, when the rotating speed is reduced, the height of the accumulated developer may increase, resulting in a failure to sufficiently collect the developer.

SUMMARY OF THE INVENTION

In one aspect of the present invention, a developing apparatus contains a developer including a toner and a carrier and develops a latent image formed on an image carrier. The developing apparatus includes a developer carrier including plural magnetic poles and disposed opposite to the image carrier; a developer regulating member configured to regulate an amount of the developer carried by the developer carrier; and a developer circulating unit configured to transport the developer in a horizontal direction in a circulating path. An edge of the developer regulating member is disposed opposite to a lower part of the developer carrier. The developer circulating unit includes a rotatable first transport member configured to supply the developer to the developer carrier while transporting the developer in the horizontal direction, a shielding member configured to prevent the developer separated from the developer carrier from flowing back toward the first transport member, and a rotatable second transport member configured to collect the developer separated from the developer carrier and transport the developer in the horizontal direction. The second transport member is spaced apart from the developer carrier by a distance greater than a distance between the developer carrier and the first transport member.

In another aspect of the present invention, a process cartridge includes the developing apparatus and at least one of the image carrier, a charging unit, and a cleaning unit in an integral manner. The process cartridge is configured to be freely attached to or detached from an apparatus main body of the image forming apparatus.

In another aspect, an image forming apparatus includes the process cartridge.

In another aspect, an image forming apparatus includes the developing apparatus.

DETAILED DESCRIPTION OF THE PREFERRED EMBODIMENTS

Figure 1:
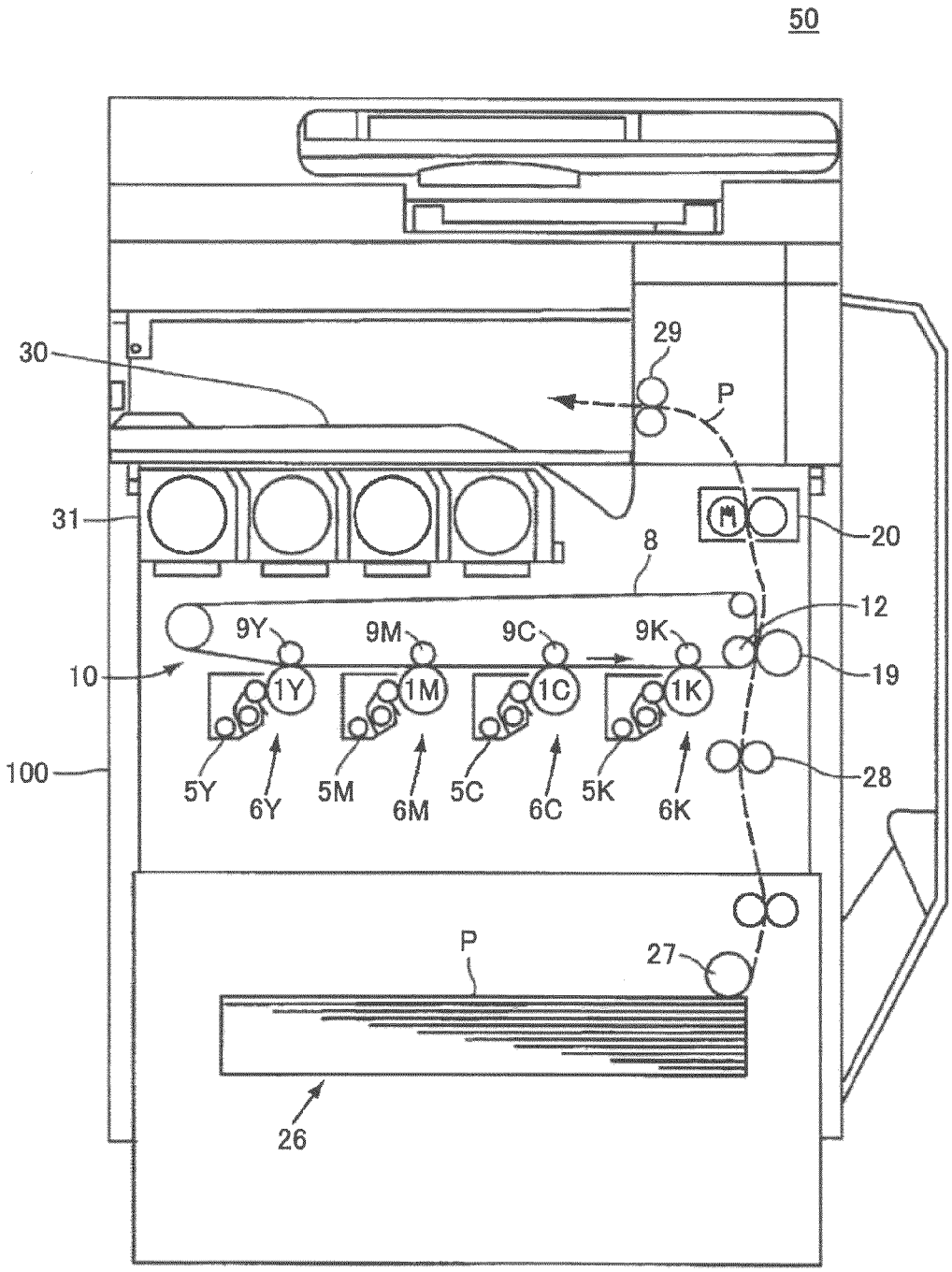
FIG 1 is a front view of an image forming apparatus according to an embodiment of the present invention.

FIG 1 illustrates a printer 50 as an image forming apparatus according to an embodiment of the present invention. The printer 50 has an apparatus main body 100 in which an intermediate transfer unit 10 is disposed at a substantially central position. The intermediate transfer unit 10 includes an intermediate transfer belt 8. Image forming units 6Y, 6M, 6C, and 6Bk corresponding to the colors of yellow (Y), magenta (M), cyan (C) and black (Bk), respectively, are disposed opposite the intermediate transfer belt 8.

The image forming units 6Y, 6M, 6C, and 6Bk have substantially identical structures, including photosensitive drums (image carriers) 1Y, 1M, 1C, and 1Bk and primary transfer bias rollers 9Y, 9M, 9C, and 9Bk, respectively. The image forming units 6Y, 6M, 6C, and 6Bk differ from one another in the color of the toner used for an image forming process. Thus, in the following description, any of the image forming units 6Y, 6M, 6C, and 6Bk may be referred to as "the image forming unit 6" for simplicity. For similar reasons, any of the photosensitive drums 1Y, 1M, 1C, and 1Bk may be referred to as "the photosensitive drum 1", while any of the primary transfer bias rollers 9Y, 9M, 9C, and 9Bk may be referred to as "the primary transfer bias roller 9".

Figure 2:
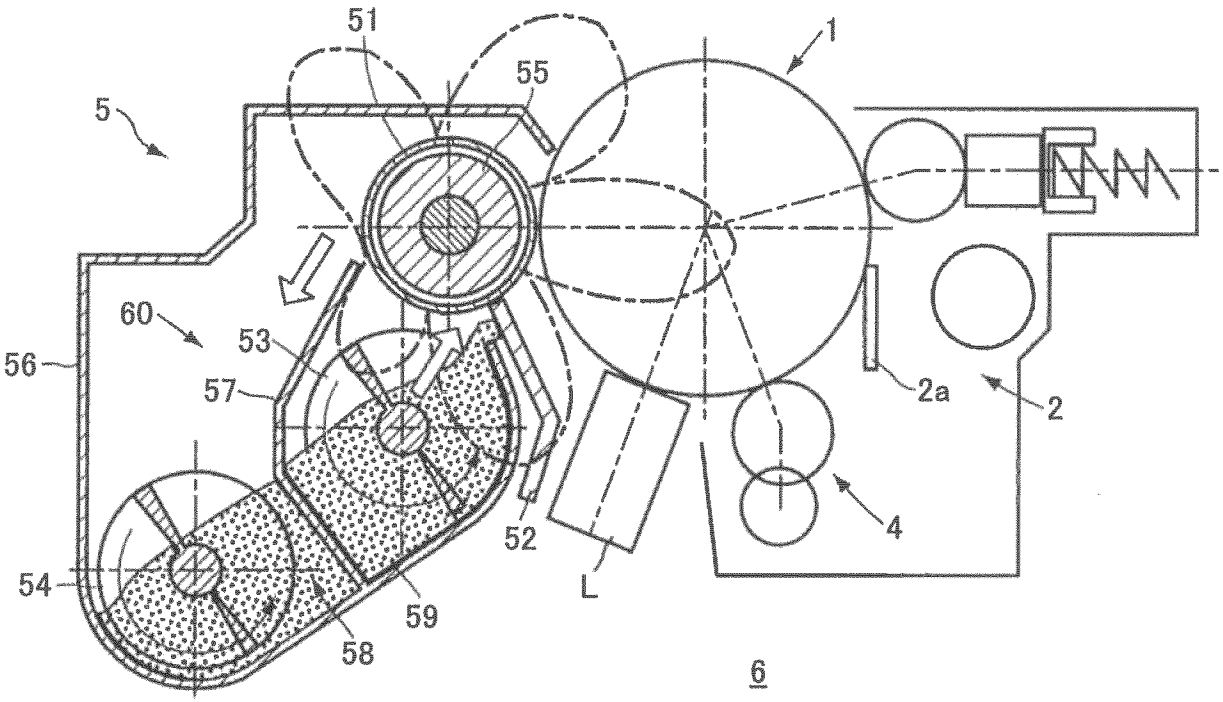
FIG 2 is a front view of an image forming unit of the image forming apparatus.

FIG 2 illustrates the image forming unit 6 of the printer 50. The image forming unit 6 may include the photosensitive drum 1. The image forming unit 6 may also include a charging unit 4, a developing apparatus 5, and a cleaning unit 2 disposed around the photosensitive drum 1. When an image forming process is performed on the photosensitive drum 1, a toner image is formed on the photosensitive drum 1 as will be described later. The image forming process may include a charging step, an exposing step, a developing step, a transfer step, a cleaning step, and a neutralizing step. The photosensitive drum 1, the charging unit 4, the developing apparatus 5, and the cleaning unit 2 may be freely attached to or detached from the apparatus main body 100 for replacement at the end of their operation life.

The developing apparatus 5 and at least one of the other units of the image forming unit 6, such as the photosensitive drum 1, the charging unit 4, and the cleaning unit 2, may be integrated to form a process cartridge that can be freely attached to or detached from the apparatus main body 100. In this way, enhanced ease of maintenance of the image forming unit 6 can be obtained.

An image forming process involving the photosensitive drum 1 is described. The photosensitive drum 1 is rotated in the clockwise direction in FIG 2 by a drive unit (not illustrated). As the photosensitive drum 1 is rotated, a surface of the photosensitive drum 1 is uniformly charged by the charging unit 4 (charging step). The charged surface of the photosensitive drum 1 is then scanned by laser light emitted from an LED array L at a laser irradiating position, thus exposing the surface and forming an electrostatic latent image thereon (exposing step).

When the latent image formed portion of the photosensitive drum 1 reaches a position opposite to the developing apparatus 5, developer is supplied to the electrostatic latent image to form a desired toner image (developing step). The toner image formed on the surface of the photosensitive drum 1 then reaches a position opposite the intermediate transfer belt 8 and the primary transfer roller 9, where the toner image is transferred onto the intermediate transfer belt 8 (primary transfer step).

At this stage, some of the toner that has not been transferred onto the intermediate transfer belt 8 may remain on the photosensitive drum 1. Thus, after the primary transfer step, the surface of the photosensitive drum 1 is cleaned at a position opposite the cleaning unit 2 (cleaning step). Specifically, in the cleaning step, the remaining toner is removed by a cleaning blade 2*a*. The surface of the photosensitive drum 1 is thereafter neutralized at a position opposite to a neutralizing unit (not illustrated) in order to remove any remaining potential (neutralizing step). This completes the image forming process according to the present embodiment of the present invention.

The image forming process is performed for each of the image forming units 6Y, 6M, 6C, and 6Bk. Thus, the photosensitive drum 1 is irradiated with the laser light, which is based on image information, from the exposing unit (LED array L), which is disposed in a lower area of the image forming unit 6. The laser light may be emitted from a light source in the exposing unit and caused to scan the photosensitive drum 1 via plural optical elements and a polygonal mirror. Thereafter, the toner images of the various colors formed on the photosensitive drums 1Y, 1M, 1C, and 1Bk after the developing step are transferred onto the intermediate transfer belt 8 and superposed one color upon another, thus forming a full-color toner image on the intermediate transfer belt 8.

The primary transfer roller 9 presses the intermediate transfer belt 8 onto the photosensitive drum 1, thereby forming a primary transfer nipping area. When the intermediate transfer belt 8 is moved in the direction of an arrow in FIG 1 and passed through the primary transfer nipping area of the primary transfer roller 9, a transfer bias of an opposite polarity to that of the toner is applied to the primary transfer roller 9 so that the toner image on the photosensitive drum 1 can be transferred onto the intermediate transfer belt 8.

The full-color toner image is then transported to a position opposite a secondary transfer roller 19, where a secondary transfer backup roller 12 presses the intermediate transfer belt 8 onto the secondary transfer roller 19, thus forming a secondary transfer nipping area. In the secondary transfer nipping area, the full-color toner image formed on the intermediate transfer belt 8 is transferred onto a sheet of transfer material P, which may include a transfer paper. At this time, some of the toner that has not been transferred onto the transfer material P may remain on the intermediate transfer belt 8. Such remaining toner is removed by an intermediate transfer belt cleaning unit (not illustrated) in order to bring the intermediate transfer belt 8 back to its initial status. This completes the transfer process performed on the intermediate transfer belt 8.

The transfer material P transported to the secondary transfer nipping area may be supplied from a sheet supply unit 26 disposed in a bottom area of the apparatus main body 100, via a sheet-feeding roller 27 and a registration roller pair 28. The sheet supply unit 26 may be configured to store a stack of plural sheets of the transfer material P. The upper-most one of the sheets is separated from the stack by the sheet-feeding roller 27 as it rotates and then transported to the registration roller pair 28. The transfer material P is temporarily stopped at a nipping position of the registration roller pair 28. The registration roller pair 28 is rotated in accordance with the timing of transport of the full-color toner image on the intermediate transfer belt 8. Thus, the sheet is transported to the secondary transfer nipping area between the intermediate transfer belt 8 and the secondary transfer roller 19, where the full-color image is transferred onto the transfer material P.

The transfer material P is then transported to a fusing unit 20. In the fusing unit 20, the full-color image is fused onto a surface of the transfer material P by heat and pressure provided by a fusing roller and a pressure roller. The fused transfer material P is then ejected by a sheet-ejecting roller pair 29 onto a stacking unit 30. This completes the image forming process in the printer 50.

Referring to FIGS. 2 through 5, the developing apparatus 5 is described. The developing apparatus 5 includes a casing 56 which houses a developing roller 51 (developer carrier) disposed opposite to the photosensitive drum 1; a doctor blade 52 (developer regulating member) with its edge disposed opposite to a bottom surface of the developing roller 51; a first transport screw 53 (first transport member) disposed within a developer container portion 59; a second transport screw 54 (second transport member) disposed within another developer container portion 58; and a collecting guide 57 (shielding member).

Within the developer container units 58 and 59, a two-component developer including a carrier and toner is stored. A toner concentration sensor (not illustrated) may be provided within the developer container units 58 and 59 to detect a toner concentration of the developer. The first transport screw 53, the second transport screw 54, and the collecting guide 57 constitute a developer circulating unit 60.

Figure 3:
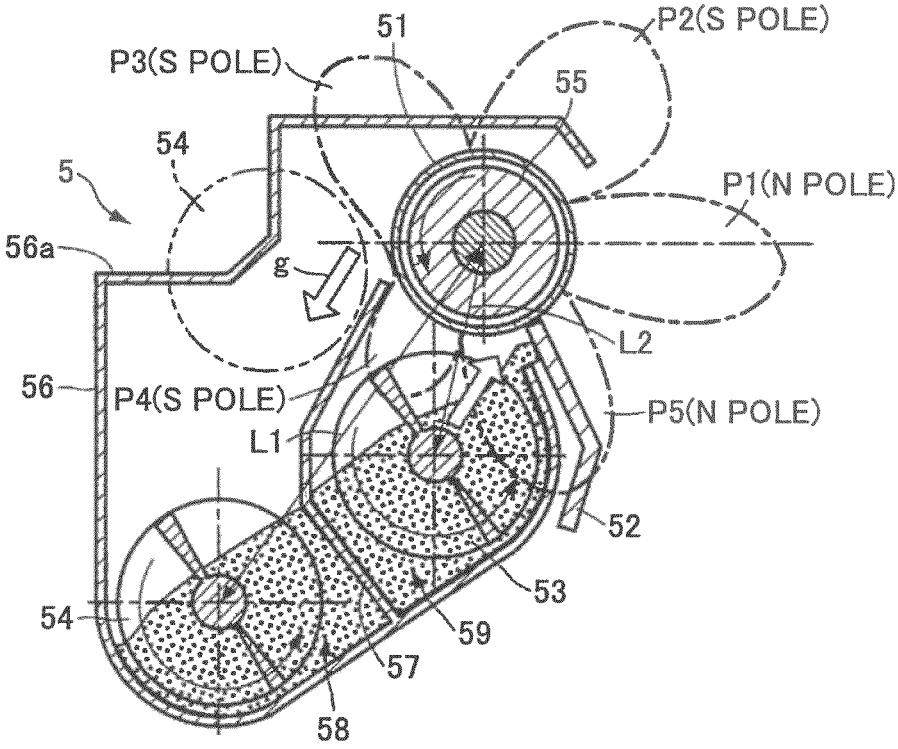
FIG 3 is a front view of a developing apparatus according to an embodiment of the present invention.

The developing roller 51 contains a magnet 55 around which a rotatable sleeve is provided. The magnet 55 has five magnetic poles P1 through P5. When the sleeve is rotated around the magnet 55, the developer is moved on the surface of the developing roller 51. In FIG 3, the positions of peaks of magnetic force of the magnetic poles P1 through P5 are indicated by the dotted lines radially extending from the developing roller 51. Between the magnetic poles P3 and P4, there is an area where none of the magnetic force is present so that the developer can be separated from the surface of the developing roller 51.

The developer contained in the developing apparatus 5 may include a uniform mixture of a toner of polyester resin as a main component with a particle size of about 5.8 μm, and 7 wt % of a carrier of magnetic fine particles with a particle size of about 35 μm. The first transport screw 53 functions as a supply screw for supplying the developer to the developing roller 51. The second transport screw 54 functions as a collecting screw for collecting the developer that has been separated from the developing roller 51.

Figure 4:
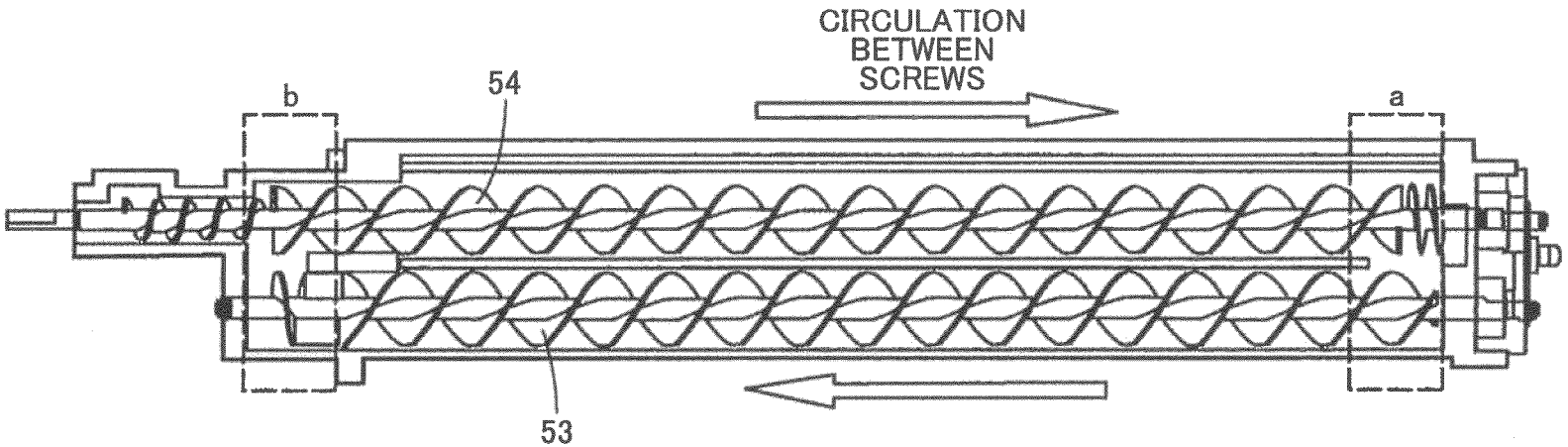
FIG 4 is a cross section of a developer circulating unit including screws according to an embodiment of the present invention.

The first and the second transport screws 53 and 54 may be rotated at 600 rpm to 800 rpm so as to simultaneously stir and transport the supplied toner, whereby the toner and the carrier are uniformly mixed and electrically charged. The developer is transported between the first and the second transport screws 53 and 54 via opening portions a and b formed in the collecting guide 57 at positions corresponding to the ends of the first and the second transport screws 53 and 54, as illustrated in FIG 4.

The uniformly mixed developer is then transported from the first transport screw 53, which is disposed in parallel and near the developing roller 51, to the surface of the developing roller 51 due to the magnetic force provided by the magnetic poles P4 and P5 of the magnet 55. As the developing roller 51 is rotated in the counterclockwise direction in FIG 3, the developer is further transported to the developing area between the photosensitive drum 1 and the developing roller 51. In the developing area, the toner adheres to the photosensitive drum 1 due to a developing electric field formed by a high-voltage power supply (not illustrated), thus developing (i.e., making visible) the electrostatic latent image.

The developer after the developing step is collected back into the developing apparatus as the developing roller 51 is rotated. The developer is then collected by the second transport screw 54 via the collecting guide 57. Thus, the first and the second transport screws 53 and 54 are arranged one higher than the other, and the doctor blade 52 is disposed under the developing roller 51. The intermediate transfer belt 8 is disposed on top of the photosensitive drum 1. In this structure, the developer used for development is circulated in one direction and not returned to the supply channel. The developing roller 51 may be rotated in a forward direction with respect to the photosensitive drum 1, in order to provide a "with-developing" system.

Figure 5:
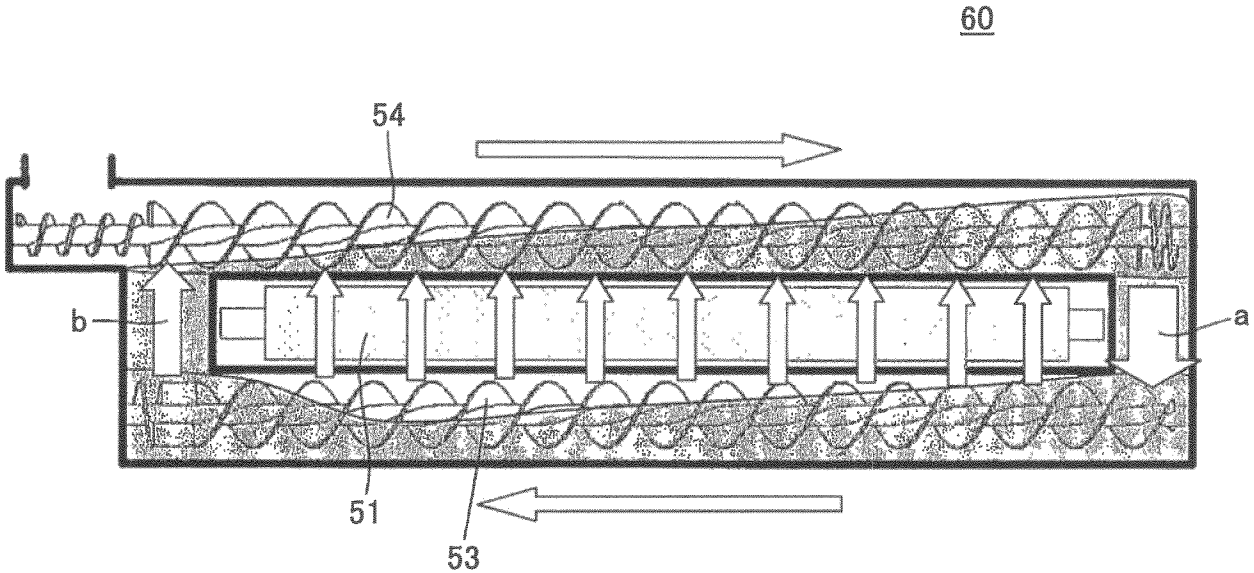
FIG 5 is a cross section of the developer circulating unit illustrating how the developer is accumulated between the screws.

FIG 5 illustrates how the developer is accumulated in the developer circulating unit 60. In accordance with the present embodiment, the developer is supplied to the developing roller 51 while the developer is stirred and transported by the first transport screw 53. All of the developer is collected by the second transport screw 54. As a result, the developer may be accumulated in an inclined manner. Specifically, the amount (i.e., height) of the developer decreases toward the downstream end of the direction of developer transport by the first transport screw 53, while the height of the developer increases toward the downstream end of the direction of developer transport by the second transport screw 54.

The developer can be uniformly transported to the developing roller 51 when Wm>Ws where Wm is a developer transport capacity determined by the diameter, pitch, and rotating speed of the first transport screw 53, and Ws is a developer transport amount on the developing roller 51. When this condition is not satisfied, there may be a lack of developer at the downstream end of the first transport screw 53, resulting in a failure to sufficiently supply the developer to the developing roller 51.

Thus, the height of the developer tends to be higher in the downstream end of the direction of developer transport by the developer circulating unit 60, as illustrated in FIG 5. Accordingly, if the second transport screw 54 is disposed near the developing roller 51 at a position indicated by the two-dot chain line in FIG 3 as according to a conventional technology, the developer separated from the developing roller 51 may not be collected by the second transport screw 54 due to the increased height of the developer on the second transport screw 54; instead, the separated developer may overflow the casing 56 or be returned back to the developing roller 51, possibly resulting in a defective image.

In accordance with the present embodiment, as illustrated in FIG 3, the second transport screw 54 is spaced apart from the developing roller 51 by a distance L1 which is greater than a distance L2 between the first transport screw 53 and the developing roller 51. Thus, the developer that has been separated from the developing roller 51 can be reliably collected and prevented from being leaked or causing a defective image. As a result, better toner distribution or charging and uniform toner concentration can be obtained, so that uniform and good images can be continuously obtained.

Furthermore, in the above configuration, because the second transport screw 54 is disposed below the first transport screw 53, the width of the developing apparatus 5 can be reduced, thus requiring less space for installation. The first transport screw 53 and the second transport screw 54 are disposed at positions such that their outer diameters appear overlapped one above the other or contacting each other when viewed from above, i.e., from the top of FIG 3. This arrangement facilitates a smooth transport of the developer from the second transport screw 54 to the first transport screw 53, thus enabling the developing step to proceed stably and continuously.

The casing 56 has a stepped portion 56*a* above the second transport screw 54. Thus, the space occupied by the developing apparatus 5 when installed in the apparatus main body 100 can be reduced by, for example, locating another component or element in the area corresponding to the stepped portion 56*a*.

In the structure of FIG 3, the rotating direction of the second transport screw 54 is the same as that of the developing roller 51. Alternatively, the rotating direction of the second transport screw 54 may be opposite to that of the developing roller 51. In this way, the height of the developer transported by the second transport screw 54 can be shifted up toward the first transport screw 53. Thus, the developer can be smoothly transported to the first transport screw 53 at the downstream end of the direction of developer transport by the second transport screw 54, thus enabling a steady supply of the developer to the developing roller 51.

Figure 6:
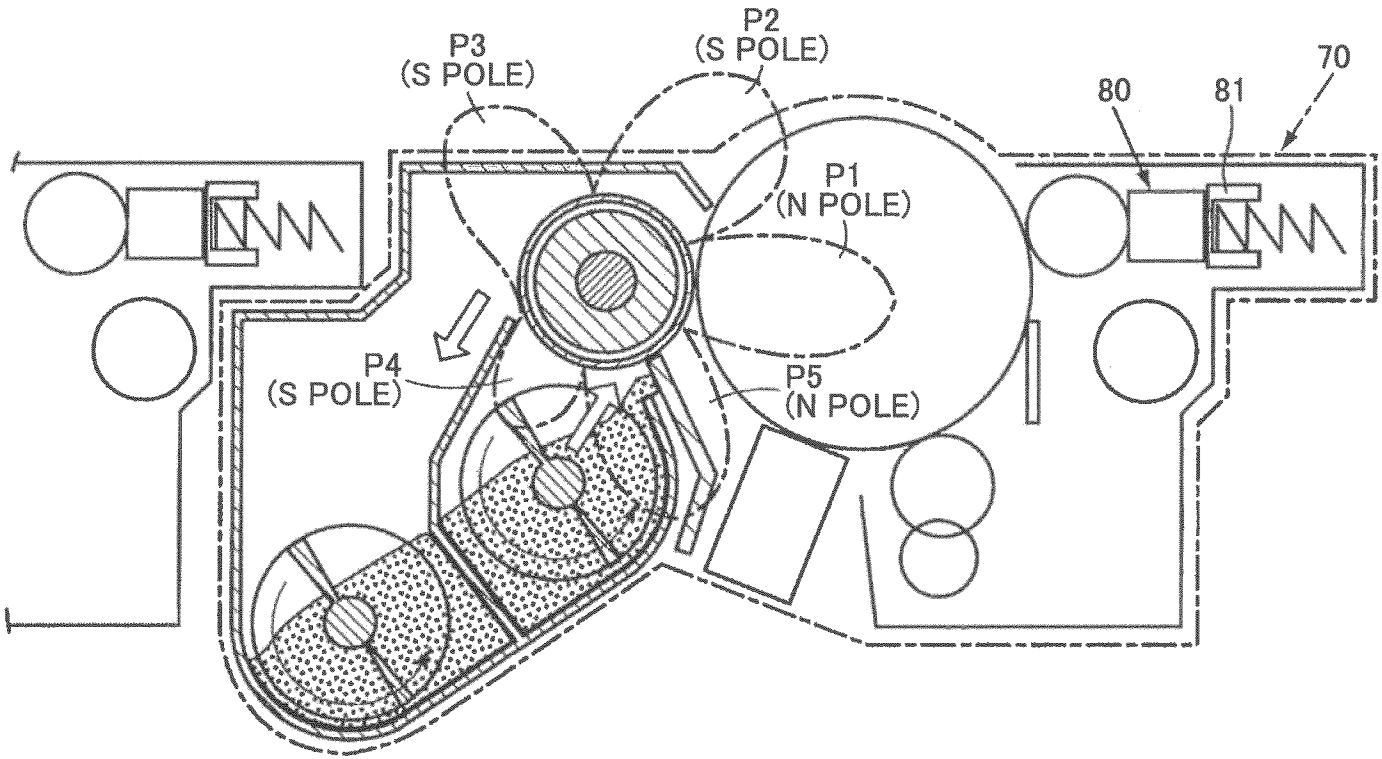
FIG 6 illustrates a process cartridge according to an embodiment of the present invention.

FIG 6 illustrates a process cartridge 70 according to an embodiment of the present invention. The process cartridge 70 includes all of the units illustrated in FIG 2. The process cartridge 70 also includes a lubricant supply unit 81 configured to supply a photosensitive body lubricant (substance) 80 to the surface of the photosensitive drum 1. In accordance with the present embodiment, the image forming unit 6 can be maintained with enhanced ease, as described above. Further, because the portion of the lubricant supply unit 81 of an adjacent image forming unit can be located in the area corresponding to the stepped portion 56*a* of the image forming unit 6, further reduction of size can be achieved.

By using toner having a shape factor SF-1 of 100 to 180 and a shape factor SF-2 of 100 to 180 in the developer, as discussed in Japanese Laid-Open Patent Publication No. 2009-122190, a high-quality image having less fogging and an increased transfer ratio can be obtained.

The image forming apparatus is not limited to the color laser printer as in the foregoing embodiments and may include other image forming apparatuses, such as copy machines, plotters, facsimile machines, or multifunction peripherals.

Although this invention has been described in detail with reference to certain embodiments, variations and modifications exist within the scope and spirit of the invention as described and defined in the following claims.

The present application is based on Japanese Priority Application No. 2010-048063 filed Mar. 4, 2010, the entire contents of which are hereby incorporated by reference.

What is claimed is:

1. A developing apparatus containing a developer including a toner and a carrier and configured to develop a latent image formed on an image carrier, the developing apparatus comprising:

a developer carrier including a plurality of magnetic poles and disposed opposite to the image carrier;

a developer regulating member configured to regulate an amount of the developer carried by the developer carrier; and a developer circulating unit configured to transport the developer in a horizontal direction in a circulating path, wherein an edge of the developer regulating member is disposed opposite to a lower part of the developer carrier, wherein the developer circulating unit includes a rotatable first transport member configured to supply the developer to the developer carrier while transporting the developer in the horizontal direction and is disposed at a position below the developer carrier such that the rotatable first transport member faces the developer carrier, a shielding member configured to prevent the developer separated from the developer carrier from flowing back toward the rotatable first transport member, and a rotatable second transport member configured to collect the developer separated from the developer carrier and transport the developer in the horizontal direction, wherein the rotatable second transport member is disposed at a position obliquely below the rotatable first transport member and spaced apart from the developer carrier by a distance greater than a distance between the developer carrier and the rotatable first transport member, and the rotatable second transport member is configured to rotate in a direction so as to lift the developer from a position obliquely below the rotatable second transport member and towards the rotatable first transport member, and wherein a first pole of the plurality of magnetic poles overlaps the rotatable first transport member and the edge of the developer regulating member.

2. The developing apparatus according to claim 1, wherein the rotatable first transport member and the rotatable second transport member both have a screw shape, and the rotatable first transport member and the rotatable second transport member are disposed relative to each other such that their outer diameters appear partly contacting or overlapping each other when viewed vertically.

3. The developing apparatus according to claim 1, further comprising a casing configured to house the developer, the developer carrier, and the developer circulating unit, wherein the casing has a stepped portion above an area where the developer circulating unit is located.

4. The developing apparatus according to claim 1, wherein the rotatable second transport member is configured to rotate in the same direction as the rotatable first transport member and the developer carrier.

5. A process cartridge comprising the developing apparatus according to claim 1 and at least one of the image carrier, a charging unit, and a cleaning unit in an integral manner, wherein the process cartridge is configured to be freely attached to or detached from an apparatus main body.

6. An image forming apparatus comprising the process cartridge and the apparatus main body according to claim 5.

7. The image forming apparatus according to claim 6, comprising:

a plurality of the process cartridge;

a plurality of the image carrier; and a plurality of substance supply units configured to supply a substance to respective surfaces of respective image carriers of the plurality of the image carrier, wherein respective substance supply units of the plurality of substance supply units are disposed above respective rotatable second transport members of respective process cartridges of the plurality of the process cartridge.

8. The image forming apparatus according to claim 6, wherein the toner of the developing apparatus has a shape factor SF-1 in a range between 100 and 180 and a shape factor SF-2 in a range between 100 and 180.

9. An image forming apparatus comprising the developing apparatus according to claim 1.

10. The developing apparatus according to claim 1, wherein the shielding member directs the developer to flow back toward the rotatable second transport member through a first opening, and the rotatable second transport member lifts the developer from the position obliquely below the rotatable second transport member and towards the rotatable first transport member through a second opening of the shielding member.

11. The developing apparatus according to claim 1, wherein a second pole of the plurality of magnetic poles is provided between the first magnetic pole and the shielding member, and the second magnetic pole overlaps the rotatable first transport member.

12. A developing apparatus containing a developer including a toner and a carrier and configured to develop a latent image formed on an image carrier, the developing apparatus comprising:

a developer carrier including a plurality of magnetic poles and disposed opposite to the image carrier;

a developer regulating means for regulating an amount of the developer carried by the developer carrier; and a developer circulating means for transporting the developer in a horizontal direction in a circulating path, wherein an edge of the developer regulating means is disposed opposite to a lower part of the developer carrier, wherein the developer circulating means includes a rotatable first transport means for supplying the developer to the developer carrier while transporting the developer in the horizontal direction and is disposed at a position below the developer carrier such that the rotatable first transport means faces the developer carrier, a shielding means for preventing the developer separated from the developer carrier from flowing back toward the rotatable first transport means, and a rotatable second transport means for collecting the developer separated from the developer carrier and transporting the developer in the horizontal direction, wherein the rotatable second transport means is disposed at a position obliquely below the rotatable first transport means and spaced apart from the developer carrier by a distance greater than a distance between the developer carrier and the rotatable first transport means, and the rotatable second transport means is configured to rotate in a direction so as to lift the developer from a position obliquely below the rotatable second transport means and towards the rotatable first transport means, and wherein a first pole of the plurality of magnetic poles overlaps the rotatable first transport means and the edge of the developer regulating means.

13. The developing apparatus according to claim 12, wherein the rotatable first transport means and the rotatable second transport means both have a screw shape, and the rotatable first transport means and the rotatable second transport means are disposed relative to each other such that their outer diameters appear partly contacting or overlapping each other when viewed vertically.

14. The developing apparatus according to claim 12, further comprising a casing for housing the developer, the developer carrier, and the developer circulating means, wherein the casing has a stepped portion above an area where the developer circulating means is located.

15. The developing apparatus according to claim 12, wherein the rotatable second transport means is configured to rotate in the same direction as the rotatable first transport means and the developer carrier.

16. A process cartridge comprising the developing apparatus according to claim 12 and at least one of the image carrier, a charging means, and a cleaning means in an integral manner, wherein the process cartridge is configured to be freely attached to or detached from an apparatus main body.

17. An image forming apparatus comprising the process cartridge and the apparatus main body according to claim 16.

18. The image forming apparatus according to claim 17, comprising:

a plurality of the process cartridge;

a plurality of the image carrier; and a plurality of substance supply means configured to supply a substance to respective surfaces of respective image carriers of the plurality of the image carrier, wherein respective substance supply means of the plurality of substance supply means are disposed above respective rotatable second transport means of respective process cartridges of the plurality of the process cartridge.

19. The image forming apparatus according to claim 17, wherein the toner of the developing apparatus has a shape factor SF-1 in a range between 100 and 180 and a shape factor SF-2 in a range between 100 and 180.

20. An image forming apparatus comprising the developing apparatus according to claim 12.

21. The developing apparatus according to claim 12, wherein the shielding means directs the developer to flow back toward the rotatable second transport means through a portion of the shielding means, and the rotatable second transport means lifts the developer from the position obliquely below the rotatable second transport means and towards the rotatable first transport means through another portion of the shielding means.

22. The developing apparatus according to claim 12, wherein a second pole of the plurality of magnetic poles is provided between the first magnetic pole and the shielding means, and the second magnetic pole overlaps the rotatable first transport means.

* * * * *